United States Patent [19]

Simmer

[11] Patent Number: 4,718,826

[45] Date of Patent: Jan. 12, 1988

[54] MOBILE PUMPING APPARATUS FOR ABRASIVE SLURRIES

[76] Inventor: Richard C. Simmer, 9518 Six Mile Ck. Rd., Tampa, Fla. 33610

[21] Appl. No.: 812,543

[22] Filed: Dec. 23, 1985

[51] Int. Cl.[4] ..... F04B 7/04

[52] U.S. Cl. ..... 417/234; 417/347; 417/900

[58] Field of Search ..... 417/46, 900, 538, 539, 417/347, 339, 234

[56] References Cited

U.S. PATENT DOCUMENTS

| | | | |
|---|---|---|---|
| 3,465,685 | 9/1969 | Sherrod | 417/46 |
| 3,907,462 | 9/1975 | Kroeger | 417/900 X |
| 3,908,865 | 9/1975 | Day | 417/900 X |
| 3,951,572 | 4/1976 | Ray et al. | 417/900 X |
| 4,533,300 | 8/1985 | Westerlund et al. | 417/900 X |
| 4,569,642 | 2/1986 | Dwyer | 417/900 X |

FOREIGN PATENT DOCUMENTS

| | | | |
|---|---|---|---|
| 2212403 | 9/1973 | Fed. Rep. of Germany | 417/900 |
| 2220098 | 11/1973 | Fed. Rep. of Germany | 417/900 |
| 2444464 | 3/1975 | Fed. Rep. of Germany | 417/900 |
| 58-190587 | 11/1983 | Japan | 417/900 |

OTHER PUBLICATIONS

*The Elephant Trunk*, Putzmeister, 1973.

*Primary Examiner*—Carlton R. Croyle
*Assistant Examiner*—Ted Olds
*Attorney, Agent, or Firm*—Herbert W. Larson; Joseph C. Mason, Jr.

[57] ABSTRACT

Mounted on a mobile platform, a dual hopper mixing tank having a hydraulically operated slide gate controlling the exit of a slurry. The mixed slurry is gravity fed to a pair of hydraulically operated pumps with the stroke of the pistons therein controlled by a reed switch or an IC chip. An outlet nozzle end from the pumps leads to a Y-shaped hose for supplying slurry continuously to a work site.

7 Claims, 6 Drawing Figures

MOBILE PUMPING APPARATUS FOR ABRASIVE SLURRIES

BACKGROUND

A. Field of the Invention

This invention relates to pumps for handling abrasive, slurries. More particularly, this invention refers to a dual system hydraulic pumping apparatus mounted on a mobile structure for pumping abrasive slurries directly to a job site.

B. Background Art

Stationary systems for pumping abrasive slurries are known as shown in U.S. Pat. Nos. 4,304,527 and 3,976,401. These systems involve complex piping and holding tanks making it virtually impossible to move pumping sites. Consequently, mixing trucks must carry slurry such as concrete to the job site or other abrasive slurries must be mixed on site and carried by primitive labor intensive steps to the point of application. An improved mobile apparatus for continuous feed pumping of abrasive materials was needed.

SUMMARY OF THE INVENTION

I have invented a pumping apparatus suitable for mounting on a mobile platform. The apparatus has a dual hopper mixing tank with provision for a hydraulically operated slide gate to allow slurry material to be pumped from one tank hopper while mixing in the other. The apparatus has a pair of hydraulically operated pumps to pump the slurry. Oil pressure is used to activate the pistons. A movable reed switch mounted on the exterior of each hydraulic cylinder housing controls the length of the stroke of the piston within each pump housing. The hydraulic piston housing is made from a non-magnetic material such as tempered alloy aluminum. A Y-shaped hose is attached to the outlet from each pump so that slurry material is continuously pumped to a work site, the rate of slurry pumped being dependent upon the setting of a variable control valve on the mixer tank. This apparatus provides for on site mixing and direct non-labor intensive movement from the mobile mixing platform to the exact point of application on the job site. Whether the slurry is applied downwardly to a pool surface or upwardly to a tall building exterior surface in a stucco job, the slurry goes directly from the mixing platform to the point of application.

BRIEF DESCRIPTION OF THE DRAWINGS

The present invention may be best understood by those of ordinary skill in the art by reference to the following detailed description when considered in conjunction wtih the accompanying drawings in which.

DESCRIPTION OF THE PREFERRED EMBODIMENT

Figure 1:
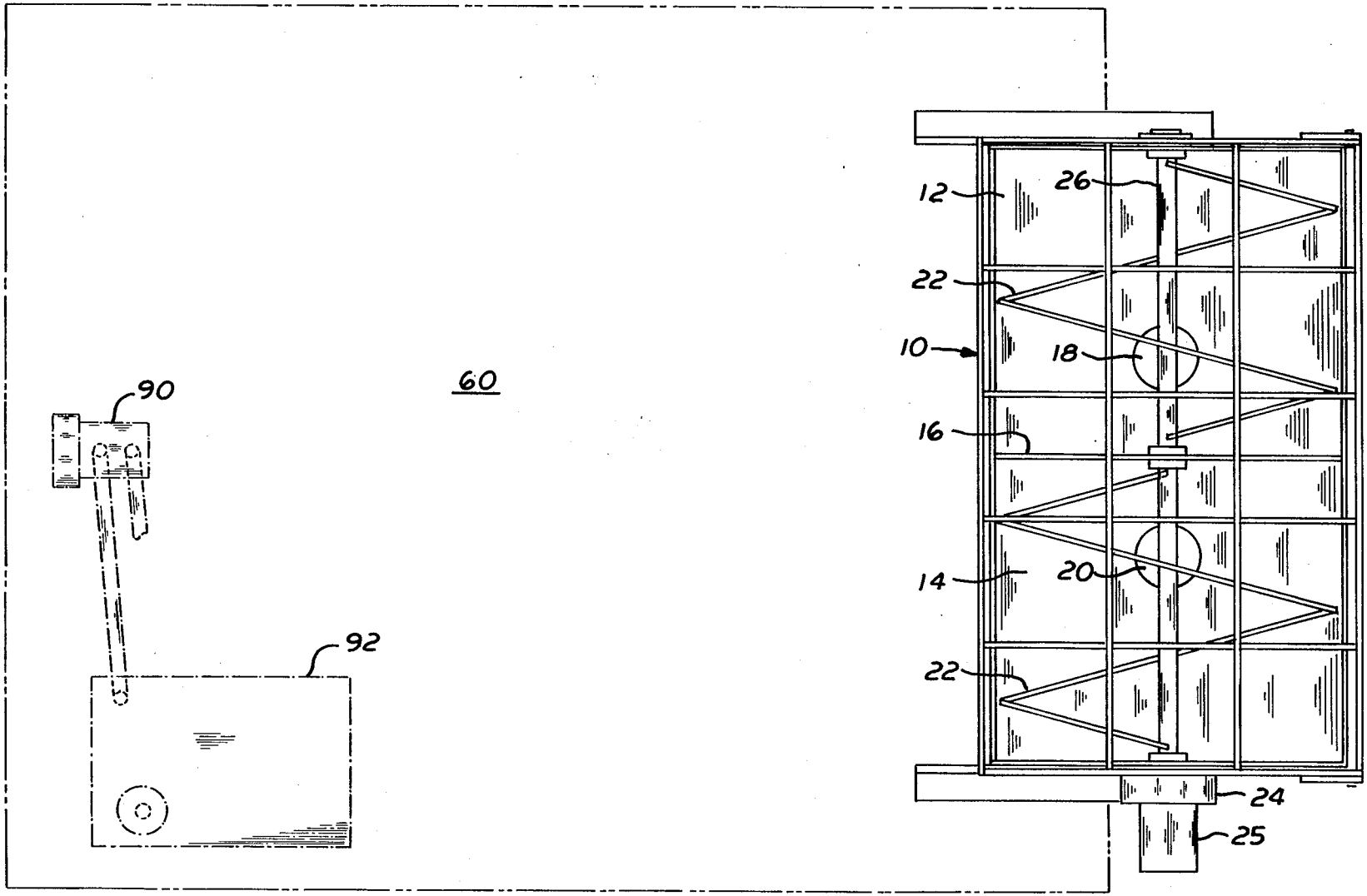
FIG. 1 is a plan view of the pumping apparatus mounted on a flat bed truck.

The pumping apparatus 10 utilizes dual mixing tanks comprising hoppers 12 and 14 with dividing wall 16 in between. At the bottom of the tanks are openings 18 and 20 respectively. A slurry is mixed in the hopper 12 or 14 with the outlets 18 or 20 respectively closed and the mixing blades 22 moving. Normally, the mixing tank is partially filled with a dry chemical substance and water to form the slurry. The mixing blades 22 are turned on a shaft 26 by a hydraulic motor 25 having a collar 24. Valve 28 controls the hydraulic fluid fed through lines 32 and the residual return fluid through 34. Cylinder 40 operating slide gate 38 is controlled by a hand operated valve 19. The slide gate operation determines which of holes 18 or 20 is open for the gravity feed of the slurry down through tubes 42 or 44 and thence into one of the pump cylinder housings 46.

The pressure in the hydraulic fluid in the entire system is monitored by gauge 36. The hydraluic reservoir 92 is the source of the oil and is pressurized by pump 90. From 90, the hydraulic fluid is pumped through splitter valve 94 and through flow control valves 28 and 30.

Figure 4:
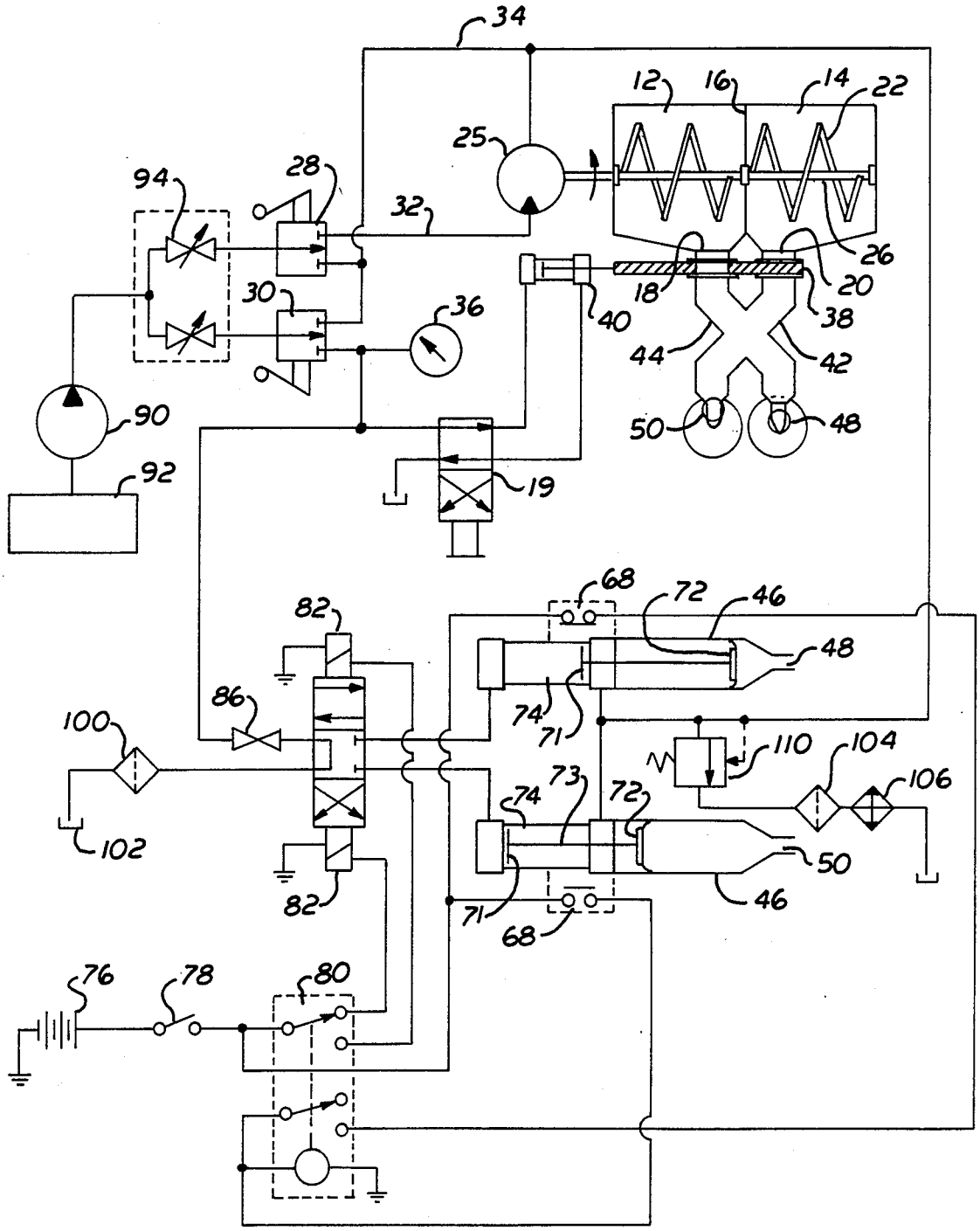
FIG. 4 is a schematic view of the hydraulic and electrical system in the pumping apparatus of FIG. 1.

Adjacent and integral with each identical pump housing unit 46 is a hydraulic cylinder piston housing 74. Piston 72 operates in the pump housing 46 whereas piston 71 operates by oil pressure in hydraulic cylinder housing 74. Rod 73 connects pistons 71 and 72. A magnetic reed switch 68 is mounted on and movable along the exterior of the cylinder housing portion 74. This reed switch controls the stroke of the piston 71 so that each piston 71 is on an opposite cycle at any given time. A pressure relief valve 101 is installed in the system for controlling the return of pistons 71. A hand operated valve 86 can be installed for convenience. Filters 100 and 104 and an optional cooler 106 is installed in the oil return line for cleaning purposes and to prevent overheating of the oil. Auxiliary reservoir 102 is connected to the main reservoir 92, although not shown on FIG. 4.

Reed switches activate relay 80 which controls the solenoid 84. This solenoid determines the egress of hydraulic fluid through the system.

Instead of the reed switch an I.C. chip can also be installed in the electrical system to perform the same function as the reed switch.

The slurry is pushed out by the pistons 72 through the pump housing 46, past inlet check valves 52 or 54 respectively and thereafter out through nozzles 48 or 50 thrugh an outlet check valve assembly and a hose (not shown) to the work site. Nozzles 48 and 50 respectively are hinged at 49 and 51 respectively so that the cylinders and inlet valves can be easily cleaned by merely opening the nozzle.

The hoppers 12 and 14 are mounted on the top surface of a flat bed truck 61 by brackets 56 and 58. The electrical power for the entire system is taken directly off the truck battery 76 and goes through power switch 78, relay 80 and solenoid 82 to give power to the system.

The underneath surface 67 of the flat bed truck 61 has suspended therefrom a hanger 66 for stabilizing the pump housing 46. Hanger 69 supports the piston cylinder housing 74 and pump housing 46. Also the hydraulic reservoir 92 is suspended and attached to the underside 61 of the flat bed truck. The hydraulic pump 90 is mechanically fastened to the power takeoff unit from the truck transmission. The flat bed truck 61 is supported on wheels 62. There can be any number of wheels on the truck depending upon the weight of the system and the apparatus used. It is noted that the bags of dry cement, aggregate or other chemical to be mixed can be stored in the open area on the top surface 60 of the truck.

Figure 2:
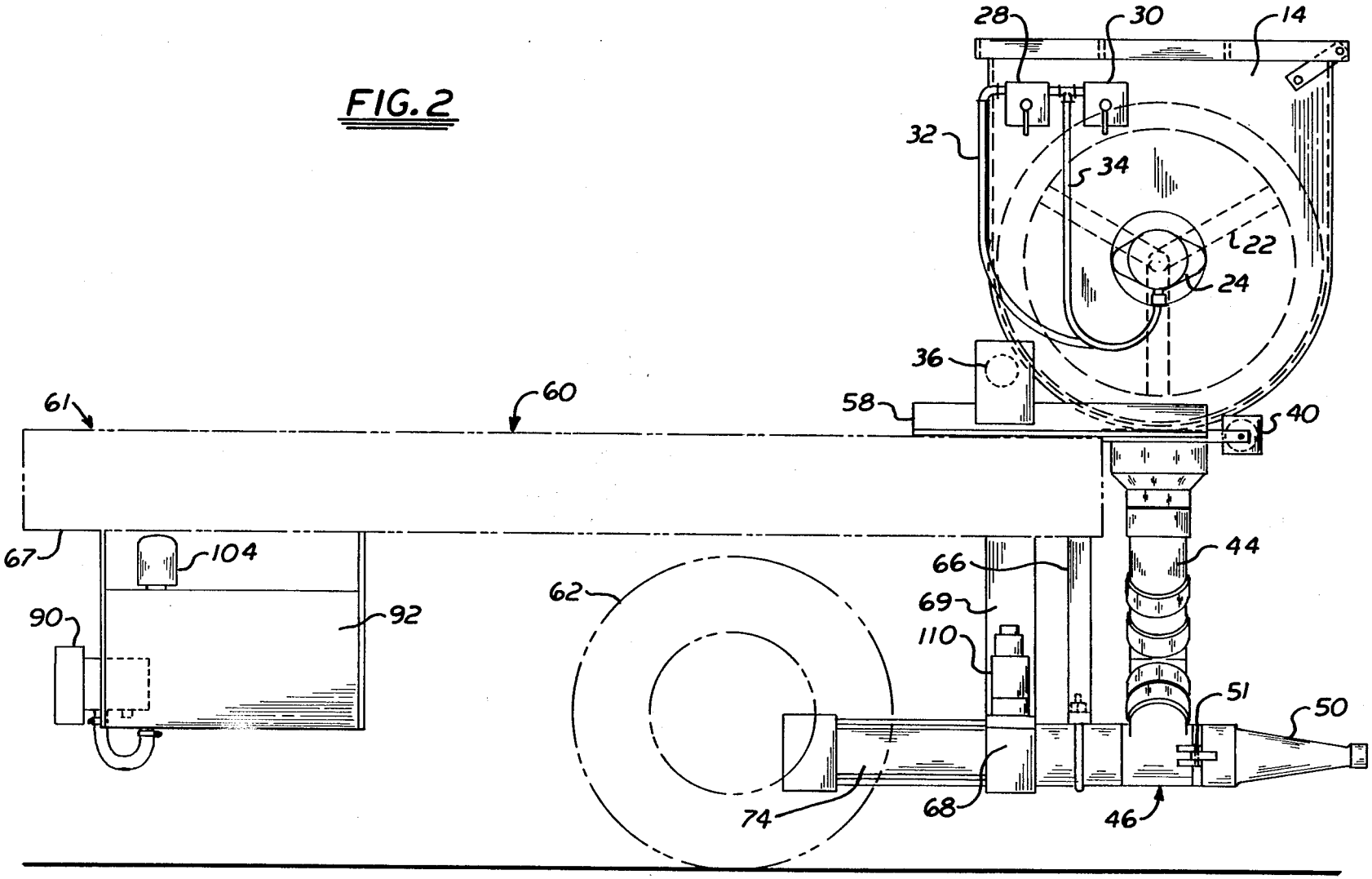
FIG. 2 is an elevation view of the pumping apparatus of FIG. 1.
Figure 3:
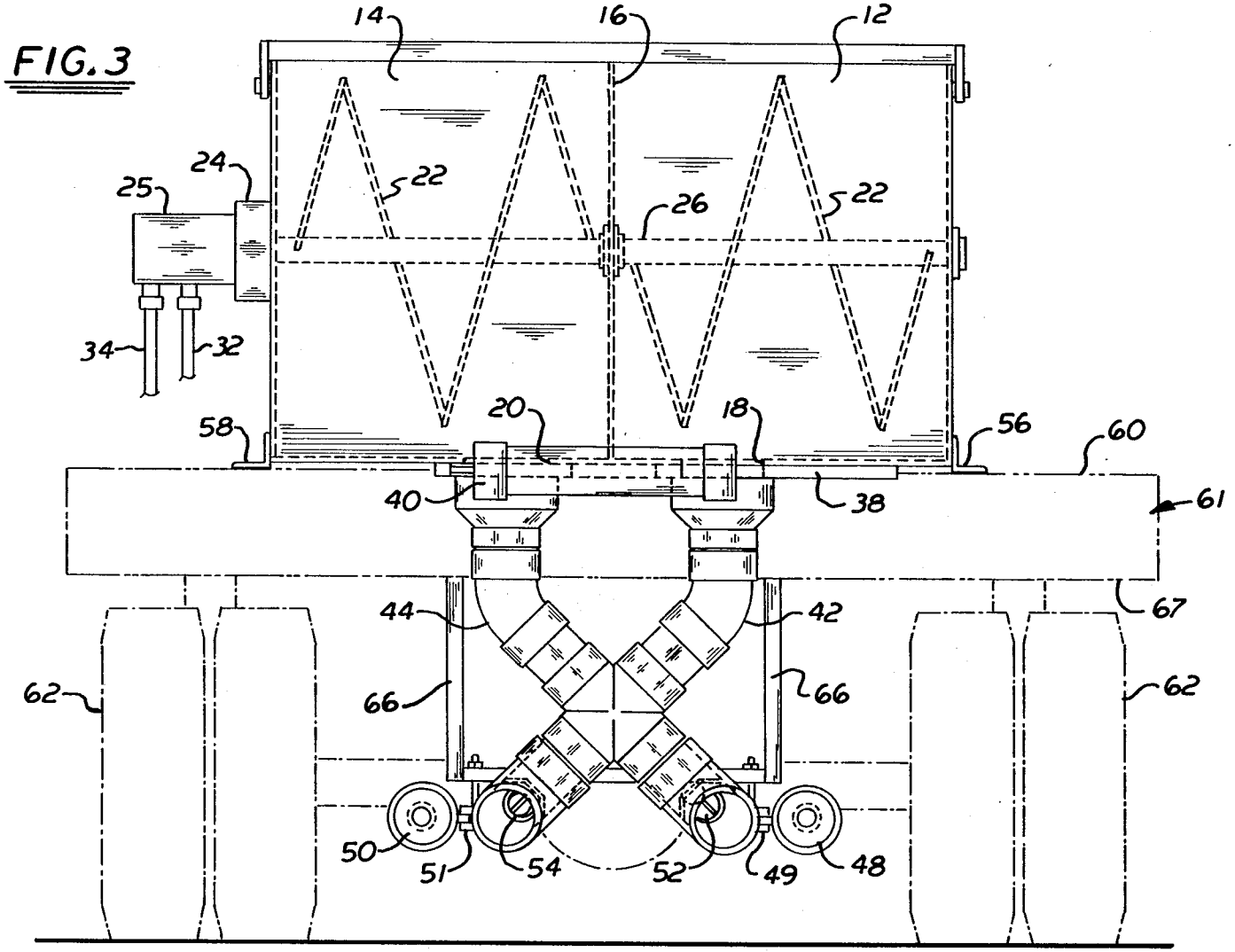
FIG. 3 is an end view of the pumping apparatus of FIG. 1.
Figure 5:
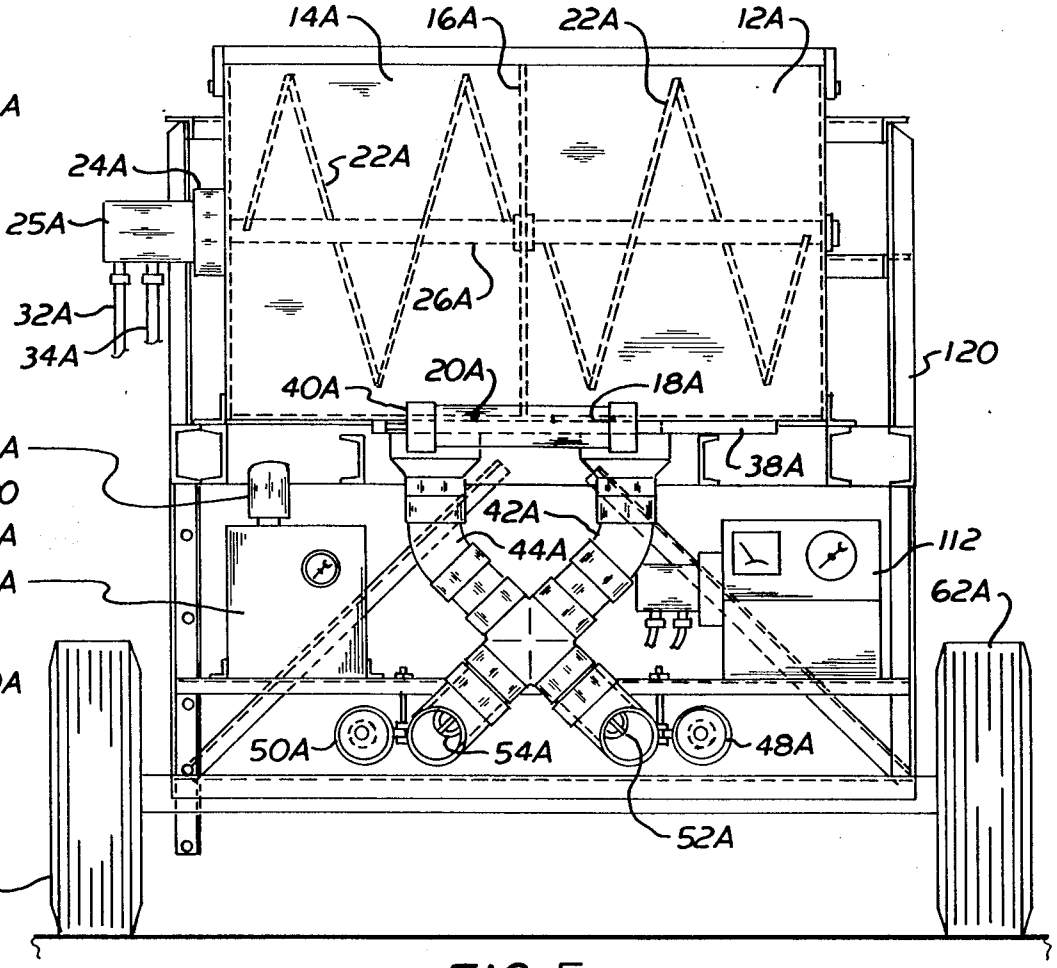
FIG. 5 shows an alternate mounting of the pumping apparatus in end view on a trailer with a separate power source.
Figure 6:
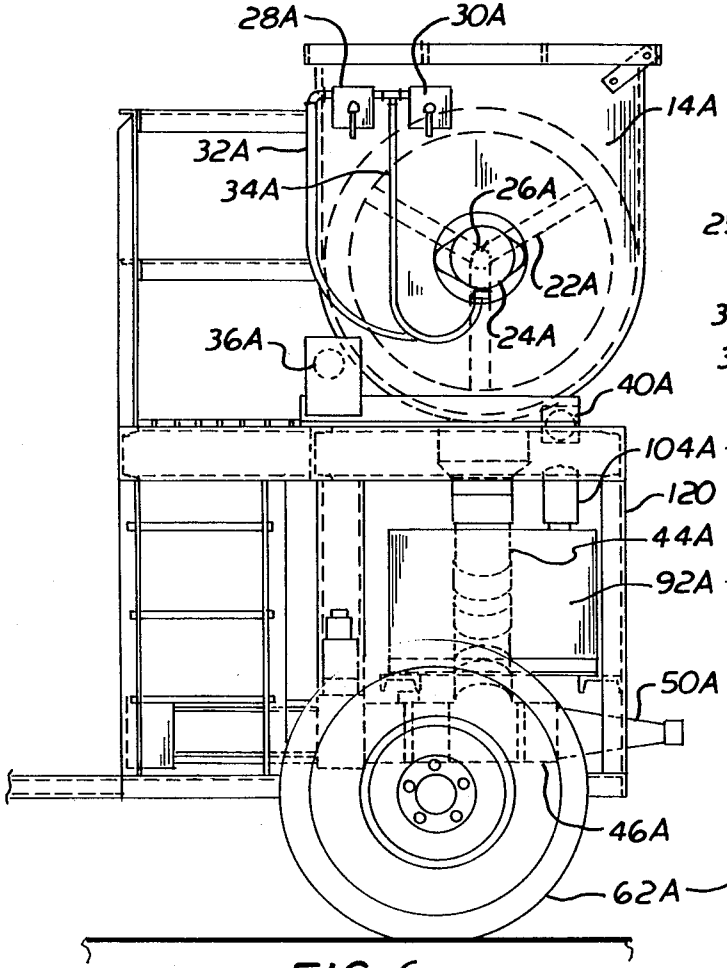
FIG. 6 is a side elevation of the pumping apparatus of FIG. 5.

An alternate mobile system seen in FIGS. 5 and 6 can comprise a trailer 120 which in all respects substitutes for the flat bed portion of the truck shown in FIGS. 1 through 3. In this instance, a power unit 112 is self contained on the trailer or can be hooked up to a truck power source. Hoppers 12A and 14A respectively perform the same functions as the hoppers shown in FIGS. 1 through 3. There is a dividing wall 16A and mixer blades 22A with a shaft 26A and hydraulic motor 25A. Valve 28A controls the hydraulic fluid fed through feedline 32A and the residual return fluid through 34A. Cylinder 40A that operates the slide gate 38A is controlled by a hand operated valve. The slurry drops down through tubes 42A or 44A respectively through holes 18A or 20A respectively to the piston housing 46A and is then pumped out through the check valves 52A or 54A and through nozzles 48A and 50A to a hose (not shown) for movement to the work site.

The housing for the piston cylinder 74 is made of nonmagnetic materials such as tempered aluminum. The position of the reed switch 68 on the cylinder housing 74 will determine the stroke of the piston 71 so that the dwell rate can be varied. In using this apparatus for placing aggregate on a pool surface the rate will be slowed down in order to facilitate application in a smooth fasion to the pool walls. A faster rate could be used in filling up holes with aggregate and again a slower rate would be used when putting stucco or plaster on the side of a building. The exact rate can be controlled by the operator merely by sliding the reed switch 68 in a mounting bracket, not shown, on the cylinder housing 74.

This apparatus can be slowly moved around a building while stucco is being applied so that a minimum crew is needed. One operator can move the truck and mix the slurry, one operator directs the hose to apply coating on the wall of a building and just one other operator can smooth the stucco on the building wall. This provides considerable labor saving in stucco operations, as well as in pool surfacing and many other uses. The apparatus is simple to operate and will provide long life in spite of the fact that abrasive substances are being pumped.

Having thus described the invention, what is clamied and desired to be secured by Letters Patent is:

1. A pumping apparatus for abrasive slurries mounted on a mobile carrier comprising:

(a) a dual hopper mixing tank fixedly mounted on a top surface of the mobile carrier, the mixing tank containing mixing blades mounted on a shaft operated by a hydraulic motor;

(b) a carrier tube leading downwardly from the bottom of each hopper to a pair of pump housings mounted beneath the mobile carrier;

(c) a hydraulically operated slide gate mounted between a bottom opening in each hopper and a top of each carrier tube to direct the delivery of slurry to the carrier tube, the slide gate allowing the selective connection of either hopper to both pump housings;

(d) each pump housing integral with a cylinder housing attached by mounting brackets to a bottom surface of the mobile carrier;

(e) a hydraulically operated piston within each pump housing and each cylinder housing;

(f) a means for controlling the stroke length of the pistons in each pump on different cycles selected from the group consisting of a reed switch mounted on the exterior surface of each pump and an I.C. chip installed within an electrical system for the apparatus; and (g) the piston within each pump housing alternately pumping slurry to an outlet end at each pump housing through a check valve assembly to a hose for continuous delivery to a work site.

2. A pumping apparatus according to claim 1 wherein the means for controlling the stroke length of the pistons is a magnetic reed switch mounted on an exterior surface of each pump cylinder housing.

3. A pumping apparatus according to claim 1 wherein the means for controlling the stroke length of the pistons is an I.C. chip installed within the electrical system of the apparatus.

4. A pumping apparatus according to claim 1 mounted on a flat bed truck.

5. A pumping apparatus according to claim 1 mounted on a trailable vehicle.

6. A pumping apparatus according to claim 3 wherein the hydraulic cylinder housing is made from tempered aluminum.

7. A method for continuously pumping abrasive surry to a work site in a pumping apparatus comprising:

(a) feeding water and appropriate dry chemical mix to a mixing tank having dual hoppers mounted on a top surface of a mobile carrier, the mixing tank containing mixing blades mounted on a shaft operated by a hydraulic motor, the blades being turned to thoroughly mix the dry chemical and water to form a slurry;

(b) hydraulically operating a slide gate positioned between a bottom opening in the hoppers and a top of a carrier tube leading from the bottom of each hopper so as to alternately allow slurry to fall by gravity to a pair of pump housings integral with a cylinder housing attached to a bottom end of the carrier tube selecting one hopper to feed both pump housings;

(c) pumping the slurry alternately from each pump housing through a check valve assembly to a hose leading to the work site, the pumping being carried out with a pump operated by a hydraulically actuated piston within each pump housing and cylinder housing, the stroke length of the piston in each pump being on different cycles and controlled by a reed switch mounted on the exterior surface of each pump or an I.C. chip installed within an electrical system for the pumping apparatus.

* * * * *